US006695095B1

(12) United States Patent
Franke

(10) Patent No.: US 6,695,095 B1
(45) Date of Patent: Feb. 24, 2004

(54) FALL PROTECTION RESTRAINT APPARATUS

(76) Inventor: Gary J. Franke, 712 Corte De Encinitas, Camarillo, CA (US) 93010

( * ) Notice: Subject to any disclaimer, the term of this patent is extended or adjusted under 35 U.S.C. 154(b) by 51 days.

(21) Appl. No.: 10/256,473

(22) Filed: Sep. 27, 2002

Related U.S. Application Data

(63) Continuation-in-part of application No. 10/190,765, filed on Jul. 9, 2002, now abandoned.

(51) Int. Cl.[7] ..... A47L 3/04

(52) U.S. Cl. ..... 182/3; 182/5; 182/7; 182/36

(58) Field of Search ..... 182/3, 5, 7, 9, 182/36, 45, 113, 133; 104/95, 112; 256/1, 59

(56) References Cited

U.S. PATENT DOCUMENTS 3,807,089 A * 4/1974 Senese ..... 47/46
4,224,722 A * 9/1980 Mikosz et al. ..... 24/234
4,345,734 A * 8/1982 Studinger ..... 248/669
4,527,660 A * 7/1985 Andruchiw ..... 182/9
4,537,395 A * 8/1985 Spinelli ..... 272/123
4,878,274 A * 11/1989 Patricy ..... 24/306
4,955,556 A * 9/1990 Frisk ..... 242/107.4 B
5,186,289 A * 2/1993 Wolner et al. ..... 188/180
5,222,991 A * 6/1993 Bell ..... 182/9
5,307,897 A * 5/1994 Turner et al. ..... 182/3
5,320,193 A * 6/1994 Bongiovanni et al. ..... 182/3
5,363,610 A * 11/1994 Thomas et al. ..... 52/167 R
5,497,394 A * 3/1996 Jhawar et al. ..... 373/130
5,518,333 A * 5/1996 Cienkus, Jr. et al. ..... 403/169
5,718,305 A * 2/1998 Palmer ..... 182/45
5,730,407 A * 3/1998 Ostrobrod ..... 248/237
5,927,431 A * 7/1999 Klein, Jr. ..... 182/3
6,027,228 A * 2/2000 Adams et al. ..... 362/252
6,173,809 B1 * 1/2001 Cole et al. ..... 182/3
6,227,329 B1 * 5/2001 Ador ..... 182/3
6,341,387 B1 * 1/2002 Zars ..... 4/504
6,443,433 B1 * 9/2002 Auldridge ..... 256/68
6,446,408 B1 * 9/2002 Gordin et al. ..... 52/632
2002/0079164 A1 * 6/2002 Choate ..... 182/36
2002/0186559 A1 * 12/2002 Hsieh ..... 362/119

* cited by examiner

*Primary Examiner*—Bruce A. Lev
(74) *Attorney, Agent, or Firm*—Albert O. Cota

(57) ABSTRACT

A fall protection restraint apparatus that is utilized during building construction comprising a base (20) that rests on the lowest floor surface of a building during construction. A number of poles (36) are connected to the base sequentially, as construction height requires, to form a structurally sound column. Support cables (40) are connected between the poles and the building under construction to horizontally support the column by forming a guyed matrix. A retractable lifeline lanyard (48) is attached to D-rings on the end cap (54) on the uppermost pole **(36*b*), thereby allowing the lanyard to expand and retract freely until a sudden tug impedes and secures the lanyard's movement. A construction worker (50) wears a fall arrest harness (52)** that is connected to the lanyard, thus providing protection. In the event of a fall, the lanyard limits and maintains the minimal distance between the worker and the column, thereby precluding a fall to the surface below.

16 Claims, 6 Drawing Sheets

FALL PROTECTION RESTRAINT APPARATUS

CROSS REFERENCE TO RELATED APPLICATIONS

This application is a continuation-in-part of application Ser. No. 10/190,765 filed Jul. 9, 2002 now abandoned.

TECHNICAL FIELD

The present invention pertains to fall protection devices in general, and more specifically to a restraint apparatus for use during building construction to protect a worker from an accidental fall.

BACKGROUND ART

Previously, many types of fall prevention devices have been used to provide an effective means to provide safety for workers during construction of residential and commercial buildings.

The prior art listed below did not disclose any patents that possess the novelty of the instant invention; however the following U.S. patents are considered related:

| Patent Number | Inventor | Issue Date |
|---|---|---|
| 5,522,472 | Shuman, Jr. et al. | Jun. 4, 1996 |
| 6,016,889 | Pearcy et al. | Jan. 25, 2000 |
| 6,334,507 | Westerweel | Jan. 1, 2002 |

Shuman, Jr. et al. in U.S. Pat. No. 5,522,472 teach a fall protection system for bridge construction that includes T-shaped cable supports secured to the concrete support columns of a bridle or overpass during construction. Cables are attached between the supports and receive a number of slideable, safety belt attachments. A construction worker wearing the appropriate safety harnesses is protected from falls as the cable secures the harness and yet leaves sufficient room for normal activity of the worker.

U.S. Pat. No. 6,016,889 issued to Pearcy et al. protects a climber from falling from a pole by utilizing a housing that fits over the top of the pole which includes a swing arm extending therefrom to which a fall protection device is attached. The swing arm may also include a cam follower assembly that includes a support component spaced apart from a closed end of the housing.

Westerweel in U.S. Pat. No. 6,334,507 discloses a fall protection system that includes a trolley that moves along anchoring lines. The anchoring lines are arranged in a parallel spaced position. The trolley has a running gear that makes contact with the lines in a low noise and vibration manner, which enables easy passage without limiting the working space of the user.

DISCLOSURE OF THE INVENTION

A safe working environment is always the goal of a construction company and the government has augmented these objectives by mandating safety requirements. A separate government agency has been implemented to promulgate these requirements, which is known as the United States Occupational Safety and Health Administration (OSHA). One of the requirements covers fall arrest systems for personnel working at elevated locations. While requirements are specific for some environments others require more workable solutions that are not fully outlined for commercial buildings, multiple story homes and apartments etc.

The primary object of the invention is to fulfill these needs by utilizing a stable rigid apparatus that is easy to erect and yet is unencumbered by protruding arms and a complex structure. This goal is achieved by the use of a simple column of tubular steel which is erected in sections that are light enough for two workers to manually handle as building progresses in height. The sections slip together into a socket that is integrally formed onto the contiguous pole, and a base is attached to a floor surface with anchor bolts placed into drilled holes in the concrete. When a height has been reached that requires stability, a series of guy wires in the form of ratchet cable pullers with integral aircraft cables are connected between lashing eyes that are attached to the poles and floor brackets, thus creating a secure matrix from each direction. The worker simply attaches a fall arrest harness with a retractable lanyard eyes onto the pole, which allows freedom to move without restriction but restrains a fall to the surface below.

An important object of the invention is the portability of the apparatus as it is sufficiently sectionalized to be handled manually and may be moved from one construction site to another with ease and dispatch.

Another object of the invention is that the cost of the apparatus is not prohibitive, as it may be used multiple times which permits the initial expense to be amortized over a lengthy period of time.

Still another object of the invention is its versatility since it may be used in all types of building structures and may be adapted to various heights by simply adding more sections of poles to the column.

These and other objects and advantages of the present invention will become apparent from the subsequent detailed description of the preferred embodiment and the appended claims taken in conjunction with the accompanying drawings.

BEST MODE FOR CARRYING OUT THE INVENTION

Figure 1:
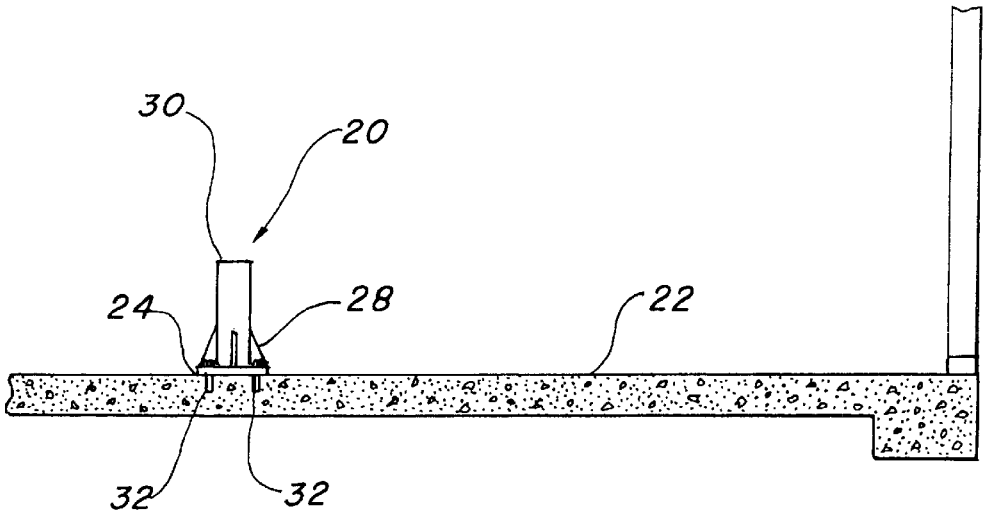
FIG. 1 is a cross-sectional view of a typical building under construction with the base of the preferred embodiment attached to a concrete floor.

The best mode for carrying out the invention is presented in terms of a preferred embodiment for a fall protection restraint apparatus, which is shown in FIGS. 1 through 21 and is comprised of a base 20 that is configured to rest on an unyielding floor surface of a building during construction, such as a concrete floor 22, as shown in FIG. 1. The base consists of a floor plate 24 having an upright pole segment 26 attached to the floor plate 24 at right angles thereunto. A socket 30 is attached to the upward extending portion of the pole segment 26, which consists of either four individual plates welded together at the corners, two angles nested together and welded at the ends, or a square tubular member slightly larger on the inside. A plurality of gussets 28 are permanently joined between the socket 30 and plate 24 to form a structurally sound integral element. The socket 30 has sufficient depth to accept longer poles and is sized to fit snugly but still permit easy insertion and removal of a mating pole. The base 20 utilizes attachment means to secure the base 20 to the concrete floor 22. The attachment means are preferably in the form of a plurality of wedging anchor bolts 32 that are disposed within a set of mounting holes 34 in the base floor plate 24 and that penetrate into the concrete floor 22, as shown in FIG. 1. Other types of mounting or securing means, well known in the art, may also be used with equal ease.

Figure 14:
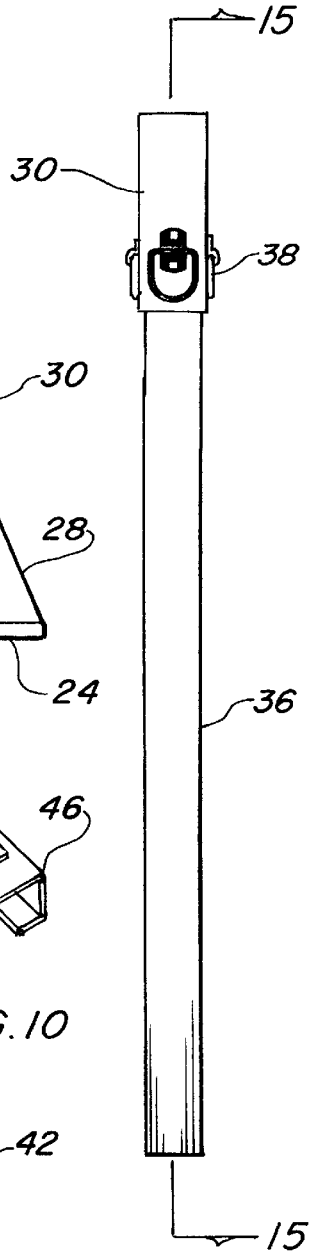
FIG. 14 is a right side view of a typical pole completely removed from the invention for clarity.
Figure 15:
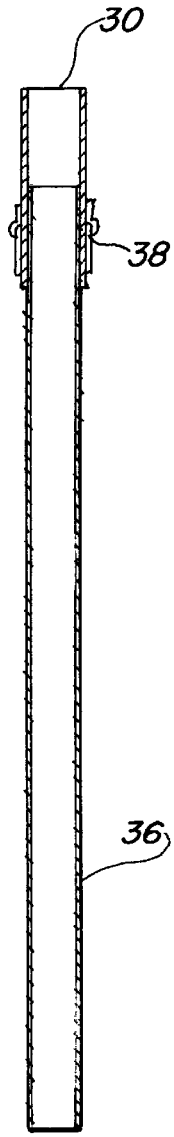
FIG. 15 is a cross-sectional view taken along lines 15—15 of FIG. 14.
Figure 9:
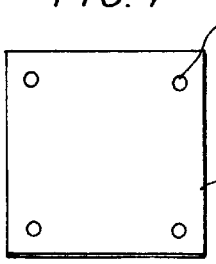
FIG. 9 is a bottom view of the base shown completely removed from the invention for clarity.
Figure 10:
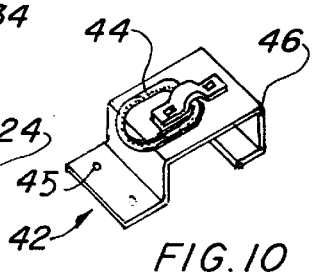
FIG. 10 is a partial isometric view of the safety pole anchor completely removed from the invention for clarity.
Figure 11:
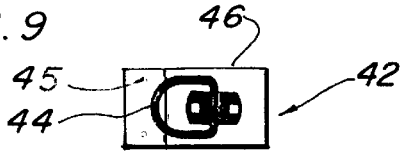
FIG. 11 is a top view of the safety pole anchor completely removed from the invention for clarity.
Figure 12:
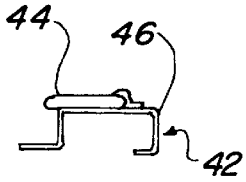
FIG. 12 is a side-elevational view of the safety pole anchor completely removed from the invention for clarity.
Figure 13:
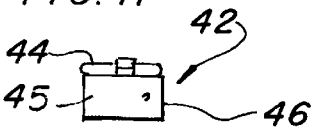
FIG. 13 is a right side view of the safety pole anchor completely removed from the invention for clarity.

A number of robust or sturdy poles 36 are sequentially connected to the base with a first pole 36*a* disposed within the socket 30 of the base 20. Subsequent poles 36 are then nested together consecutively, as construction height requires, thus forming a rigid structurally sound column. Basically, each pole 36 includes a distal socket 30 on one end similar to the one described above for the base 20, as best illustrated in FIGS. 14 and 15. It should be noted that the length of each pole 36 may vary as to the height of the building and FIGS. 14 and 15 represent only one specific embodiment and the others are basically identical except as noted. A plurality of lanyard hooks and cable anchors 38 are permanently attached to the sides of the socket 30, as shown, and consist of either a D-ring as illustrated, or a rotating lashing ring, which is not shown but well known to those practicing the art of hold downs. Both types of rings may be used adjacent to each other or one variety may be employed for a dual purpose of attachment. Further, other types of hold downs or loops may be used with equal ease. At least one of the poles 36 has additional lanyard hooks and cable anchors 38 positioned above a floor line at least 8 feet (2.5 m) from a floor surface of a building under construction, when the poles are nested together forming the column. The addition of the lanyard hooks and cable anchors 38 relative to the floor line is depicted best in FIGS. 3–5.

Figure 4:
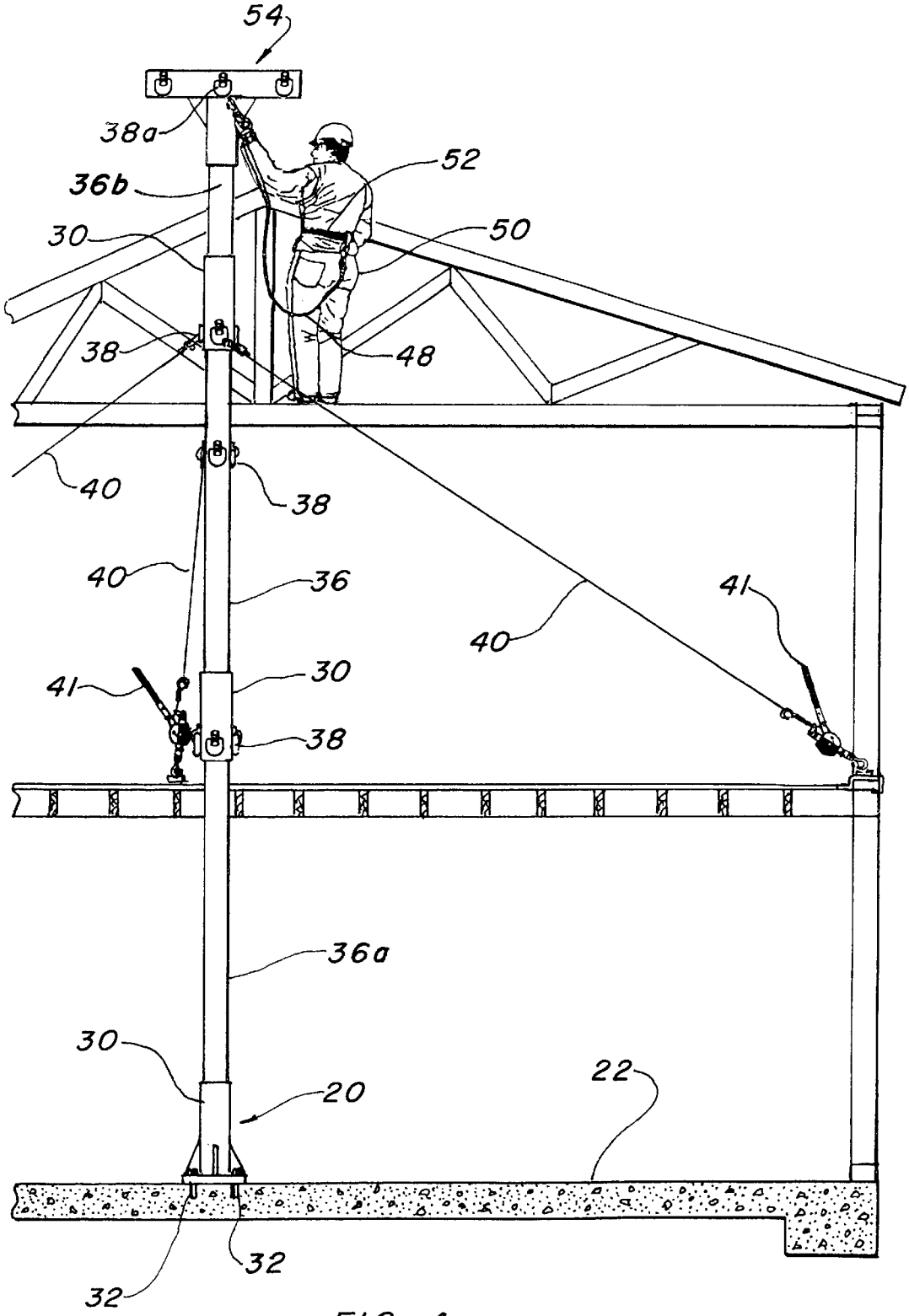
FIG. 4 is a cross-sectional view of a typical building under construction as shown in FIG. 3 with the addition of a low pitched roof. The third pole or uppermost pole, having an end cap, is installed in the socket of the second pole and support cables are attached to the second pole.
Figure 5:
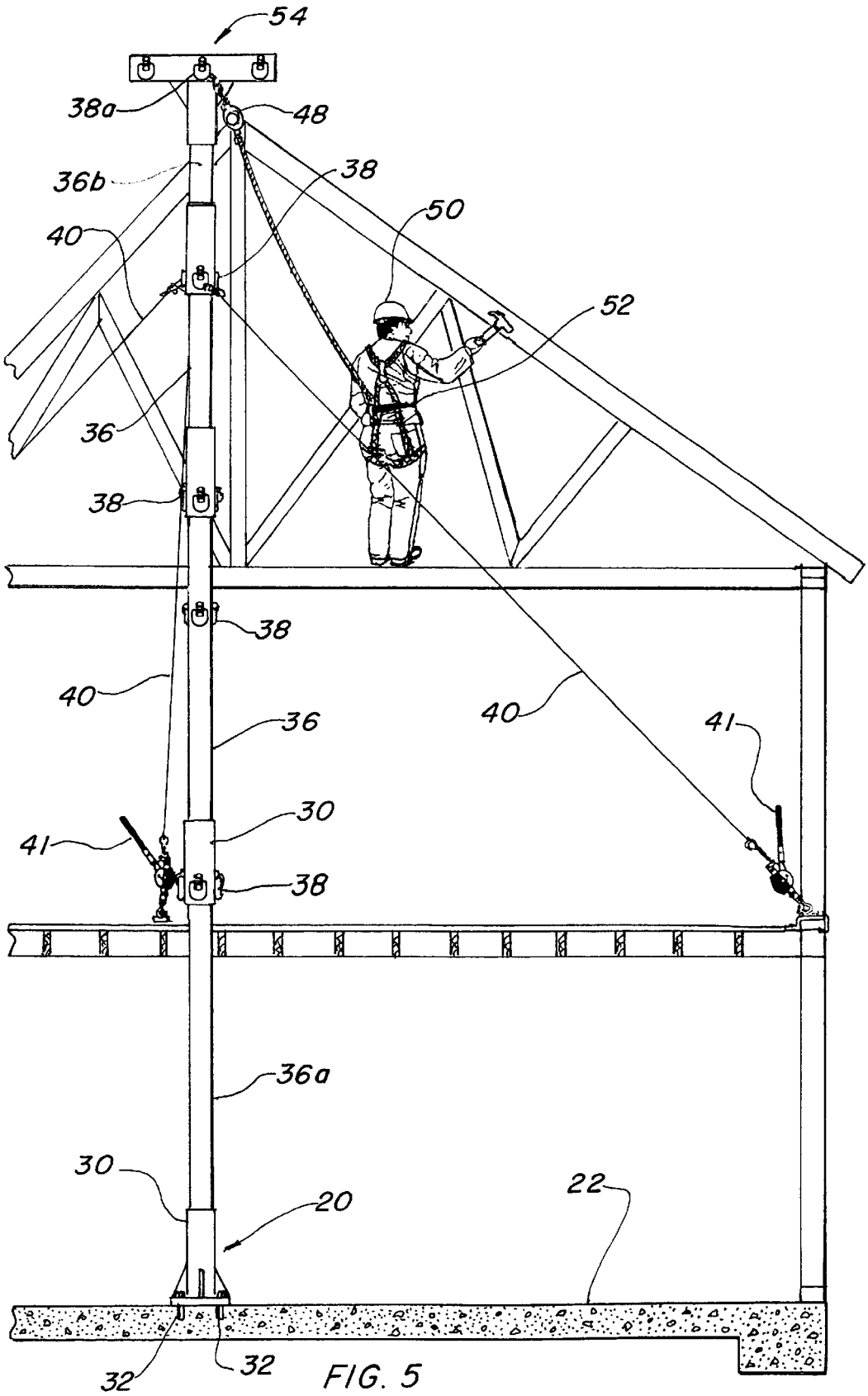
FIG. 5 is a cross-sectional view of a typical building under construction with as shown in FIG. 3 except with a high pitch roof requiring an additional fourth or uppermost pole having an end cap installed in the socket of the third pole.
Figure 6:
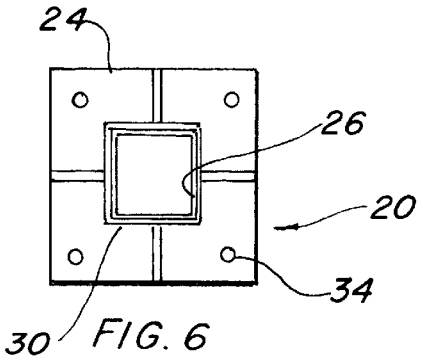
FIG. 6 is a top plan view of the base shown completely removed from the invention for clarity.
Figure 7:
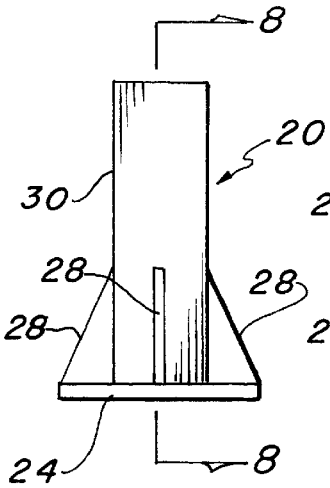
FIG. 7 is a side-elevational view of the base shown completely removed from the invention for clarity.
Figure 8:
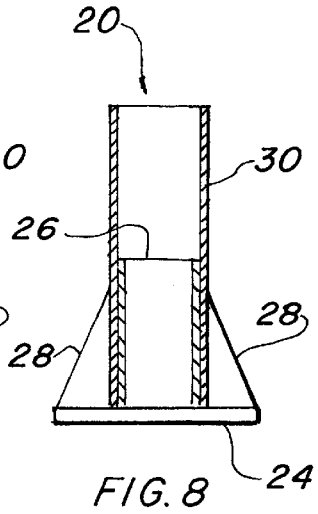
FIG. 8 is a cross-sectional view taken along lines 8—8 of FIG. 7.
Figure 16:
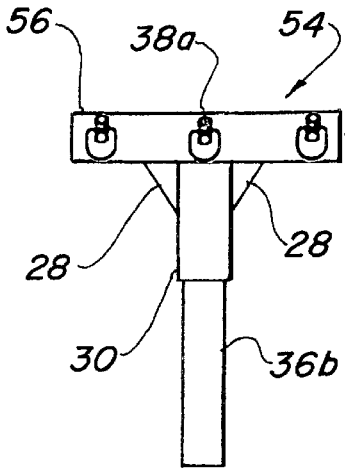
FIG. 16 is a front elevation view of the third or uppermost pole with the end cap in place, completely removed from the invention for clarity.
Figure 17:
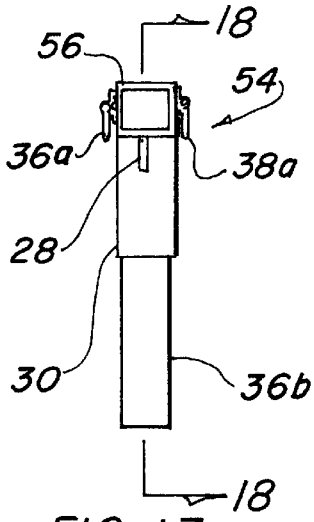
FIG. 17 is a side view of the uppermost pole with the end cap in place, completely removed from the invention for clarity.
Figure 18:
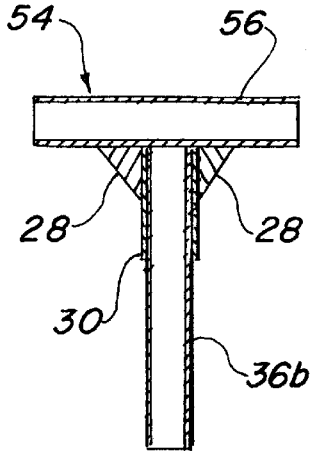
FIG. 18 is a cross-sectional view taken along lines 18—18 of FIG. 17.
Figure 19:
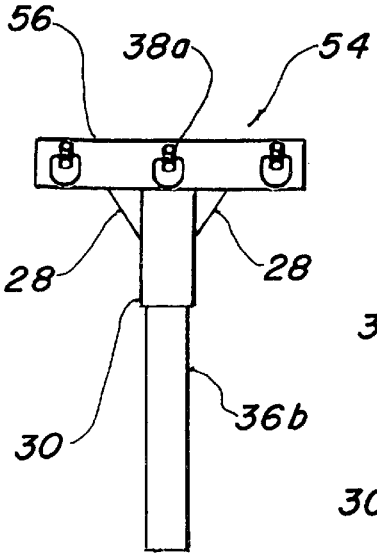
FIG. 19 is a side view of the fourth or uppermost pole with the end cap in place, completely removed from the invention for clarity.
Figure 20:
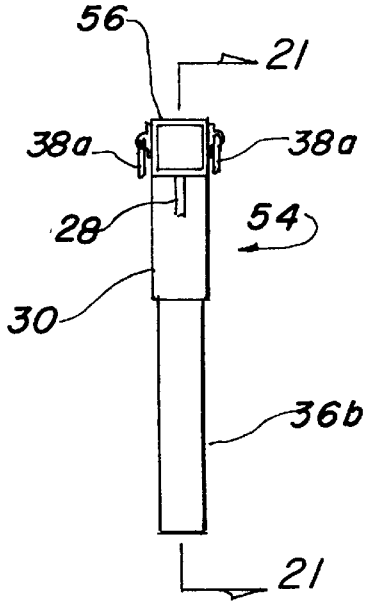
FIG. 20 is a front elevation view of the uppermost pole with the end cap in place, completely removed from the invention for clarity.
Figure 21:
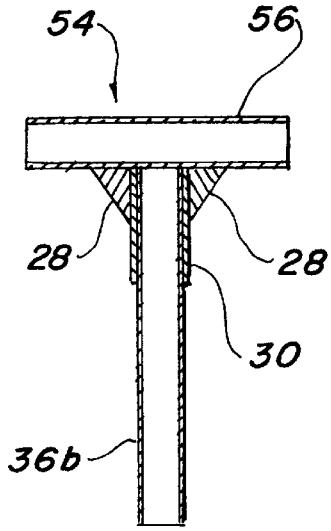
FIG. 21 is a cross-sectional view taken along lines 21—21 of FIG. 20.

On the uppermost pole 36*b* the distal socket 30 is formed into a tee-shaped end cap 54 that includes a plurality of lanyard hooks 38*a* affixed on each side. It is preferred that the lanyard hooks 38*a* are in the form of D-rings which are easy to use, well known in the art and readily available. The tee-shaped end cap 54 consists of a vertical socket 30 that is basically the same as used in the lower sections except it has a horizontal top member 56 attached at right angles to the socket 30. A plurality of gussets 28, preferably two are attached between the vertical socket 30 and the horizontal top member 56 reinforcing the end cap structure. FIGS. 16–21 illustrate two forms of the end cap 54 attached to pole sections 36 with FIGS. 16–18 depicting the length of the uppermost pole 36*b* corresponding to FIG. 4 and FIGS. 19–21 depicting the length of the sections of the uppermost pole 36*b* as illustrated in FIG. 5. The end cap 54 serves the purpose of providing attaching means, all at the same height, for a number of workers since the D-rings are spaced apart sufficiently to be convenient.

It should be noted that the description of the preferred embodiment of the pole 36 and its socket 30, while appearing to be the most practical approach, may be altered or substituted without changing the patentable limitations of the invention. It is suggested that a round, square or a structural shape is an acceptable alternative, and the socket 30 may be either male or female with a myriad of profiles and combinations forming a satisfactory solution.

A plurality of support cables 40 are connected between the pole 36 and the building under construction to horizontally support the column by forming a guyed matrix. The support cables 40 are preferably incorporated in a ratchet cable puller 41 which includes not only an integral aircraft cable, but attaching hooks, an interlocking drive and stop levers. The cables 40 are attached with the integral hook to the appropriate cable anchor on the pole socket 30 or pole itself, while simultaneously also attached on the other end to a safety pole anchor 42 that includes the pivoting ring 44 and a bracket 46. The anchor 42 is configured to rest on the floor and partially enclose one of the building's structural floor plates while being nailed through holes 45 provided to accommodate removable detachment. The anchor 42 is illustrated best in FIGS. 10–13 by itself, and installed in FIGS. 3–5.

One or more retractable lifeline lanyards 48 are attached to the column, thereby allowing the lanyard 48 to expand and retract freely until a sudden tug impedes and secures the lanyard's movement. This lanyard 48 preferably includes a built in anchorage connector, and an integral cable on a spring-loaded drum with a swivel snap hook on the cable for connection to the harness. The lanyard 48 is illustrated in the hand of a worker 50 in FIGS. 4 and 5, and is well known in the art. It should he noted that various types and styles of lanyards 48 may be employed, such as the shock-absorbing type.

A fall arrest harness 52 is connected to the lanyard 48 for securing the construction worker 50. The lanyard 48 limits and maintains a minimal distance between the worker 50 and the column, thus precluding a fall to the surface below as the lanyard 48 is attached to the lanyard hooks 38 on pole 36, sockets 30 or the D-rings on the end cap 54. The fall arrest harness 52 is comprised of at least a body belt and can include a seat strap or even a full chest harness. The harness must meet or exceed government and industry standards. FIGS. 4 and 5 illustrate such a harness worn by a worker 50.

Figure 2:
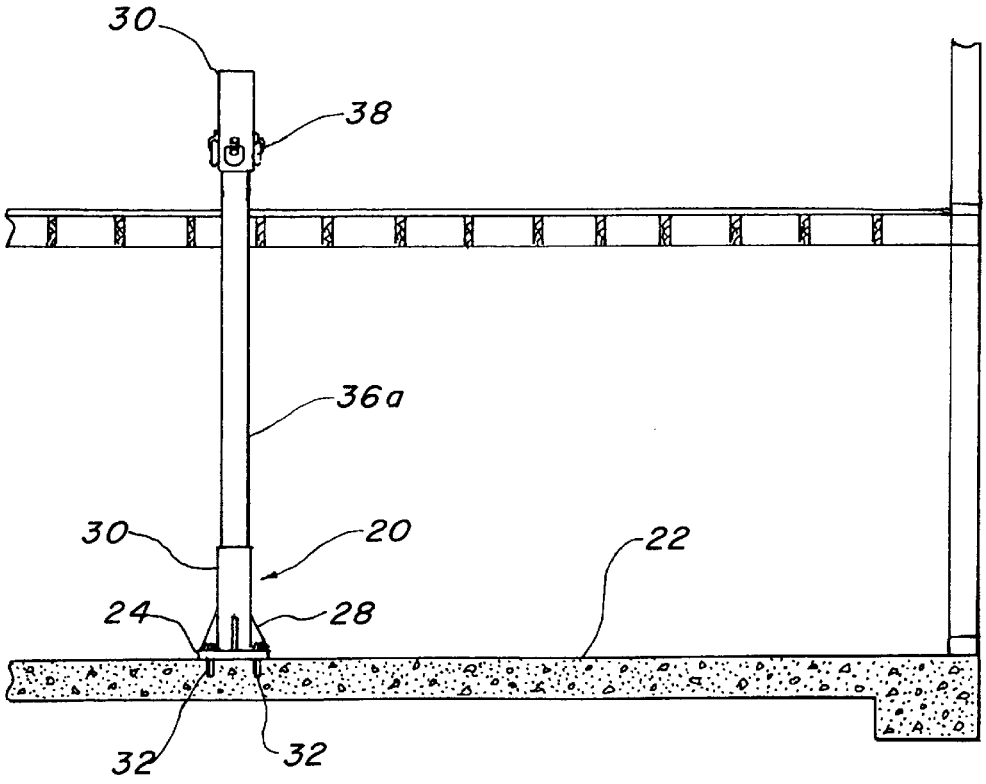
FIG. 2 is a cross-sectional view of a typical building under construction with the first pole installed in the socket of the base with its distal end protruding above the first floor of the building.
Figure 3:
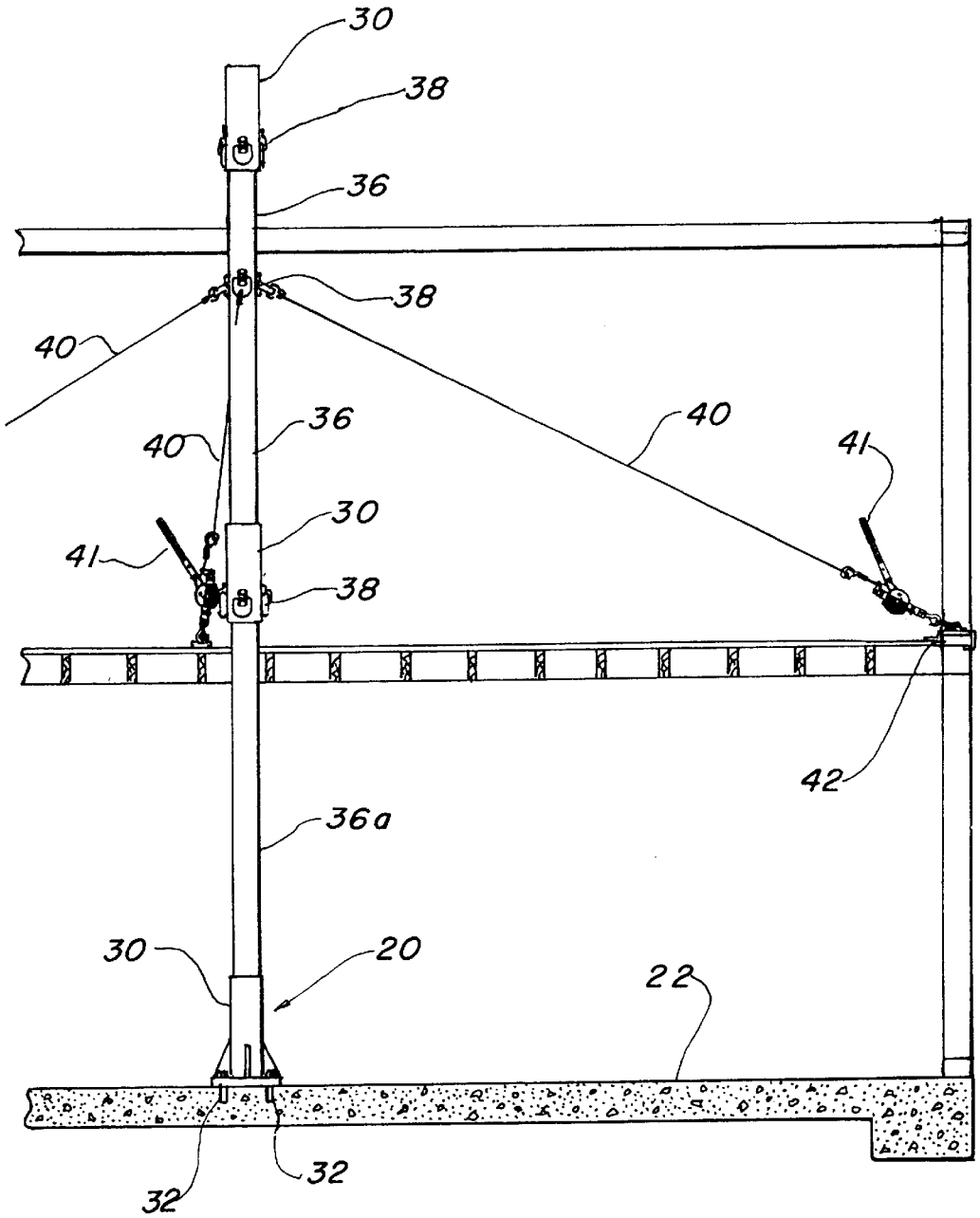
FIG. 3 is a cross-sectional view of a typical building under construction with the second pole installed in the socket of the first pole and the second pole secured with the support cables attached to the building.

To install the apparatus in a building under construction, the base 20 is placed on the lowest floor and secured in place with the anchor bolts 32, as illustrated in FIG. 1. The first pole 36*a* is manually placed in the socket 30 of the base 20 which projects above the subsequent floor line of the structure, as shown in FIG. 2. When the next floor line or ceiling is established, another pole 36 is added to the column, as depicted in FIG. 3, and the support cables 40 are installed from the stacked column diagonally to the building structure. When the buildings roof trusses are rolled, an uppermost pole 36*b* is added to the column having the end cap 54 installed, as illustrated in FIG. 4 and 16–18 or if the roof is the high pitch type, a third pole 36 is required along with a shorter uppermost pole 36*b*, as shown pictorially in FIG. 5 and 19–21. In either event, the support cables 40 are repositioned to a higher set of cable anchors 38. When the column is secured, the worker 50 wearing the harness 52 with the lanyard 48 attached connects the lanyard 48 to the lanyard hook in the form of a D-ring 38 which, by the way, may be the same hook as the cable anchor 38 or may be separate device, however both are designated element number 38. While two or three poles 36 and a uppermost pole 36*b* are illustrated, any number and length combination may be used for specific buildings and heights.

While the invention has been described in complete detail and pictorially shown in the accompanying drawings, it is not to be limited to such details, since many changes and modifications may be made to the invention without departing from the spirit and scope thereof. Hence, it is described to cover any and all modifications and forms which may come within the language and scope of the appended claims.

What is claimed is:

1. A fall protection restraint apparatus adapted to be secured to a building during construction comprising, a) a base resting on a floor surface of a building during construction, b) a plurality of poles with a first pole connected to the base and subsequent poles nested together sequentially, as construction height requires, thus forming a structurally sound column, wherein each pole having a distal socket on one end, wherein said distal socket on an uppermost pole is defined as a tee-shaped end cap having a plurality of lanyard hooks, c) a plurality of support cables connected between the poles and a building under construction to horizontally support the column by forming a guyed matrix, d) at least one retractable lifeline lanyard attached to the column, thereby allowing the lanyard to expand and retract freely until a sudden tug impedes and secures the lanyard's movement, and e) at least one fall arrest harness connected to the lanyard such that securement is provided to a construction worker wearing the harness, in the event of a fall the lanyard limits and maintains the minimal distance between the worker and the column, thus precluding a fall to the surface below.

2. The fall protection restraint apparatus as recited in claim 1 wherein said base further comprises a floor plate having an upright pole attached to the floor plate at right angles thereunto, a socket attached to an upward-extending portion of the upright pole, and a plurality of gussets permanently attached between the socket and plate, thereby forming a structurally sound integral element.

3. The fall protection restraint apparatus as recited in claim 1 wherein said floor surface is defined as a concrete floor and said base having attachment means to secure the base to the concrete floor.

4. The fall protection restraint apparatus as recited in claim 3 wherein said attaching means to secure the base to the concrete floor further comprise said base having a plurality of mounting holes therein with a plurality of wedging anchor bolts disposed within the mounting holes to penetrate into the concrete floor.

5. The fall protection restraint apparatus as recited in claim 1 wherein said each pole having a distal socket on one end.

6. The fall protection restraint apparatus as recited in claim 1 wherein said lanyard hooks further comprises a plurality of D-rings attached securely to the end cap.

7. The fall protection restraint apparatus as recited in claim 1 wherein said tee-shaped end cap further comprising a vertical socket having a horizontal top member attached at right angles to the socket and a plurality of gussets attached between the vertical socket and the horizontal top member reinforcing the end cap structure.

8. The fall protection restraint apparatus as recited in claim 1 wherein said poles having a plurality of lanyard hooks and cable anchors attached thereupon.

9. The fall protection restraint apparatus as recited in claim 1 wherein at least one pole having lanyard hooks and cable anchors positioned above a floor line of a building under construction when the poles are nested together to form the column.

10. The fall protection restraint apparatus as recited in claim 9 wherein the above said floor line of a building under construction is at least 8 feet (2.5 m) from a building under construction floor surface.

11. The fall protection restraint apparatus as recited in claim 1 wherein said support cables further comprise ratchet cable pullers which include an integral aircraft cable, attaching hooks, interlocking drive and stop levers.

12. The fall protection restraint apparatus as recited in claim 1 wherein said support cables further comprise a safety pole anchor having a pivoting ring and a bracket configured to rest upon a floor and partially enclose a structural floor plate for removable attachment thereof.

13. The fall protection restraint apparatus as recited in claim 1 wherein said retractable lifeline lanyard further comprises an anchorage connector and an integral cable with a swivel snap hook on the cable for connection to the harness.

14. The fall protection restraint apparatus as recited in claim 1 wherein said fall arrest harness further comprises at least a body belt.

15. A fall protection restraint apparatus adapted to be secured to a residential or a multiple building during construction comprising, a base resting on a floor surface of a building during construction, a plurality of poles with a first pole connected to the base and subsequent poles nested together sequentially, as construction height requires, thus forming a structurally sound rigid columns, wherein each pole having a distal socket on one end, wherein said distal socket on an uppermost pole is defined as a tee-shaped end can having a plurality of lanyard hooks, a plurality of support cables connected between the poles and the building under construction to horizontally support the column by forming a guyed matrix, at least one lanyard attached to the column, and a fall arrest harness connected to the lanyard such that securement is provided to a construction worker wearing the harness, in the event of a fall the lanyard limits and maintains the minimal distance between the worker and the column, thus precluding a fall to the surface below.

16. A fall protection restraint apparatus adapted to be secured to a residential or a multiple building during construction comprising, a base resting on a floor surface of a building during construction, a pole connected to the base having a height, as construction requires to form a rigid column, said pole having a distal socket defined as a tee-shaped end cap having a plurality of lanyard hooks, a plurality of support cables connected between the poles and the building under construction to horizontally support the column, at least one lanyard attached to the column, and a harness connected to the lanyard such that securement is provided to a construction worker wearing the harness, in the event of a fall the lanyard maintains the distance between the worker and the column.

* * * * *